US008905190B2

(12) United States Patent
Stromland et al.

(10) Patent No.: US 8,905,190 B2
(45) Date of Patent: Dec. 9, 2014

(54) ACCESS SYSTEM, A METHOD OF ASSEMBLY, A SUPPORT ELEMENT, A GUIDING ELEMENT AND AN EXTRUDED PROFILE FOR THE SYSTEM

(75) Inventors: Ole Petter Stromland, Ski (NO); Willy Arnold Fagerland, Valer I Ostfold (NO)

(73) Assignee: Noracon AS, Copenhagen (DK)

( * ) Notice: Subject to any disclaimer, the term of this patent is extended or adjusted under 35 U.S.C. 154(b) by 624 days.

(21) Appl. No.: 12/994,629

(22) PCT Filed: May 26, 2009

(86) PCT No.: PCT/NO2009/000195

§ 371 (c)(1),
(2), (4) Date: Feb. 3, 2011

(87) PCT Pub. No.: WO2009/145637

PCT Pub. Date: Dec. 3, 2009

(65) Prior Publication Data

US 2011/0120801 A1 May 26, 2011

(30) Foreign Application Priority Data

May 26, 2008 (NO) ..... 20082371

(51) Int. Cl.
*E04G 3/28* (2006.01)
*E04G 1/20* (2006.01)
*B66B 9/187* (2006.01)

(52) U.S. Cl.
CPC .. *E04G 1/20* (2013.01); *B66B 9/187* (2013.01)
USPC ..... 182/141

(58) Field of Classification Search
USPC ..... 182/82, 141
See application file for complete search history.

(56) References Cited

U.S. PATENT DOCUMENTS 36,951 A * 11/1862 Harper ..... 182/141
3,313,376 A 4/1967 Holland, Sr.

(Continued)

FOREIGN PATENT DOCUMENTS

FR 2774370 A1 8/1999
GB 1420591 1/1976

(Continued)

OTHER PUBLICATIONS

PCT/NO2009/000195 International Search Report, Nov. 4, 2009 (6 p,).

(Continued)

*Primary Examiner* — Katherine Mitchell
*Assistant Examiner* — Candace L Bradford
(74) *Attorney, Agent, or Firm* — Conley Rose, P.C.

(57) ABSTRACT

An admission system, particularly for containers, with a raiseable platform. The system includes towers of carryable profiles with at least one longitudinal recess adapted for interference by at least one steering element. Each profile has an end portion adapted for interference with other carryable profiles. The profiles have the same cross-section and can be joined. Interlocking elements are placed between the profiles for joining. A toothed rack extends along the longitudinal direction of the profiles. A guiding element for connection with a working platform is connected to the at least one steering element and includes a pinion meshing with the toothed rack and a transmission for driving the pinion. Support elements are provided for attaching the profiles to a structure or other profiles. The invention also includes a method for assembly of such a system, a profile, a guiding element and support elements for such a system.

11 Claims, 11 Drawing Sheets

(56) References Cited

U.S. PATENT DOCUMENTS

| | | | | |
|---|---|---|---|---|
| 3,782,048 | A | 1/1974 | Corman | |
| 4,078,633 | A * | 3/1978 | Fahy | 182/82 |
| 4,294,332 | A | 10/1981 | Ready | |
| 4,303,169 | A | 12/1981 | Grey | |
| 5,271,482 | A | 12/1993 | Walz | |
| 6,182,791 | B1 * | 2/2001 | Cope | 182/141 |
| 6,695,097 | B1 * | 2/2004 | Wiklund | 182/141 |
| 7,044,269 | B2 * | 5/2006 | Azran | 182/141 |
| 7,090,051 | B2 * | 8/2006 | Robillard | 182/146 |
| 2003/0010568 | A1 * | 1/2003 | Wyse | 182/118 |
| 2003/0188922 | A1 * | 10/2003 | Duplessis | 182/18 |
| 2009/0178883 | A1 * | 7/2009 | Castle | 182/19 |
| 2011/0061971 | A1 * | 3/2011 | Monkl et al. | 182/3 |

FOREIGN PATENT DOCUMENTS

| | | | | |
|---|---|---|---|---|
| NL | 1019494 | C1 | 6/2002 | |
| WO | 8702914 | A1 | 5/1987 | |
| WO | WO 8702914 | A1 * | 5/1987 | B66F 11/04 |
| WO | 9322529 | A1 | 11/1993 | |
| WO | 9405587 | A1 | 3/1994 | |

OTHER PUBLICATIONS

Office Action for Norwegian Application No. 20082371, Nov. 21, 2008 (3 p.).

* cited by examiner

ACCESS SYSTEM, A METHOD OF ASSEMBLY, A SUPPORT ELEMENT, A GUIDING ELEMENT AND AN EXTRUDED PROFILE FOR THE SYSTEM

CROSS-REFERENCE TO RELATED APPLICATIONS

This application is a 35 U.S.C. §371 national stage application of PCT Application No. PCT/NO2009/000195, filed 26 May 2009, and entitled "Access system, a method of assembly, a support element, a guiding element and an extruded profile for the system," hereby incorporated herein by reference, which claims priority to Norwegian Patent Application No. 2008 2371, filed 26 May 2008, hereby incorporated herein by reference.

STATEMENT REGARDING FEDERALLY-SPONSORED RESEARCH OR DEVELOPMENT

Not applicable.

BACKGROUND

The present invention concerns an admission system, a method for assembly of such a system, a guiding element, a longitudinal extruded profile and a support element for the admission system. The invention is particularly adapted for providing admission to cooling units or refrigerators on containers.

There are numerous movable assemblies that are able to elevate a platform to provide admission to cover various needs.

For instance U.S. Pat. No. 5,067,587 shows a scaffolding system with a platform that can be elevated and that can move up and down along a truss structure by means of pinions and toothed racks extending along the truss structure.

In U.S. Pat. No. 5,159,993 it is shown a self-elevating working platform assembly where a platform can move up and down along two towers. In U.S. Pat. No. 4,262,773 it is shown a portables scaffolding where several element can be placed on top of each other and where the elements are secured to each other during assembly.

When using containers with cooling units, it has been a problem that cooling units can fail and must be exchanged. Because of this, it is therefore common to only stack two containers on top of each other on a container deck of a container ship, to be able to gain access to the cooling units to exchange them if they fail. If cooling units fail and not are repaired or exchanged within short time, considerable values may get lost. Such containers typically include groceries. The present invention is particularly adapted to allow containers with cooling units to be stacked at a desired height independently of the need for admission, as the invention enables access to the cooling units even if the containers are stacked at a height that otherwise not would be possible due to the concerns mentioned above. The invention may of course also be used in connection with other admission needs in places where it is necessary to be able to easily assemble and disassemble an admission system, and where there are practical limitations to reaching the height that is desired. The invention is also sufficiently portable such that each element of the equipment can be carried by one person. When the description mentions cooling units, this is only the most common application. However is of course the point with such units or refrigerators only to provide a controlled environment in the containers, and equipment for heating, control of air humidity or any other needs that require admission, is intended to be covered by the needs that can be solved with the present invention.

These and other problems are solved with apparatuses and methods according to the invention.

SUMMARY OF THE INVENTION

The present invention thereby concerns an admission system. The admission system is particularly adapted for use in connection with servicing units on containers, but may also be used for other purposes. The admission system may include a foot piece for attaching at least one preferably carriable profile and will thereby form a portal or base. The foot piece is typically made of aluminium, and ensures certain stability for profiles that are placed in the foot piece. The foot pieces may also be made such that they can be carried by for instance the crew of a vessel. Each element should ideally be designed such that it can be carried and handled by one person. The elements may therefore also be equipped with handles. The admission system typically includes a longitudinal, first, carriable profile with at least one longitudinally extending recess adapted for contact by at least one rolling element. The end portions of each profile is adapted for interference with a second carryable profile with a similar cross section as the first profile, such that the profiles can be joined without forming a substantial edge between the profiles and such that a first profile forms an elongation of the second profile without any variation in the cross section. At least one interconnecting element for joining the first profile and the second profile is placed internally in the profiles and creates an inner support ensuring that the profiles are aligned with each other. A toothed rack extends along the profiles in their longitudinal direction. A guiding element for connection with a working platform is connected to rolling elements. The guiding element further includes a pinion for meshing into the toothed rack and a transmission for driving the pinion. At least one support element for attaching the profiles of the admission system to other structures, for instance containers, buildings or terrain the admission system is to be placed close to, is provided to maintain a certain stability.

The particular adaptation makes the system particularly suitable for admission to containers with cooling units. The support elements may be particularly adapted for attachment to containers in that the support elements include elements for contact with containers as explained below. The carriable profiles may be of a length that is adapted to the height of one container. The length may typically be in a suitable fraction of the height of a container and may for instance be 1, ½ or ⅓ of a container height.

The various elements may be equipped with handles.

Furthermore the invention concerns a method for assembly of an admission system assembled by carriable elements, along a wall of stacked containers. The method includes placing at least one foot piece on a surface where the containers are placed, and placing at least one first extruded profile with a toothed rack in the foot piece and thread at least one guiding element with rolling elements, pinion for meshing a toothed rack and a transmission for driving the pinion on the at least one first profile. A working platform can then be attached to the at least one guiding element. At least one second extruded profile with the same cross section as the first profile can then be attached on the first profile by interconnecting elements. At least one of the profiles is then attached to at least one of the containers with a support element. The platform can then be elevated through at least one meshing element by operation of the pinion by the transmission. A third profile corresponding to the other profiles can then be assembled on the second element with the interconnecting elements. The steps above can then be repeated until the platform can be raised or elevated at a desired height. In this manner may the admission system be built by elevating the elements on the platform. This eliminates the need for a crane for admission from the outside during assembly of the system.

Furthermore the invention includes a longitudinal extruded profile for a platform that can be elevated. The profile includes at least a first recessed portion in the longitudinal direction of the profile for contact with a first rolling element on a guiding element, at least one portion for attachment of a toothed rack, and at least one slit for securing a support element.

The profile may furthermore include at least two internally placed holding portions for attachment of at least two interconnecting elements. The holding portions may include open deformation portions to allow deformation of the holding portions when the interconnecting elements are inserted.

The profile may further include a second recessed portion for contact with at least one second rolling element on the guiding element.

Furthermore the invention concerns a guiding element for an admission system with a platform adapted to be led along a longitudinal, extruded profile as defined above. The guiding element includes a substantially u-shaped extruded profile with a substantially plane bottom portion and substantially plane side portions. At least one internal slit is placed in each of the substantially plane side portions for attachment of rolling elements. The at least one internal slit may be adapted for installation of a bolt with a bolt head or for installation of a rail part with attached bolts extending out of the slit in a common way. Rolling elements are in this way attached to the side portions. At least one pinion driven by a transmission is attached to the u-shaped extruded profile. A support element for attachment of a platform is furthermore attached to the profile. The guiding element furthermore includes a locking assembly for locking the guiding element to the longitudinal extruded profile.

Furthermore the invention includes a support element for attachment of a longitudinal extruded profile to a container. Such containers include openings for attachment with two parallel sides, and between the parallel sides rounded end portions such that it is formed longitudinal holes. The support element includes a hollow longitudinal portion, typically of an extruded aluminium profile, with two ends. A rod shaped body extends internally in the hollow longitudinal portion and is connected to a mechanism for tightening the rod shaped body. A portion for contact or connection attached at one end of the rod includes a plate shaped body that is adapted to go into the attachment opening of the container and to be able to be locked to this opening by turning the plate shaped body approximately 90 degrees when the body has been inserted into the opening of the container. The mechanism for tightening the rod shaped body may include an internally threaded tightening element screwed onto a threaded portion of the rod shaped body at the other end of the hollow longitudinal portion for tightening the plate shaped body towards the longitudinal hole after insertion. The plate shaped interconnecting portion may include pins that can go into holes in a part at the end of the hollow longitudinal portion, such that it is easy to feel when the plate shaped interconnecting portion is in the right position, and to ensure that it not is turned out of contact with the sides in the elongated hole of the container.

Other elements for tightening of the rod shaped body may alternatively be used instead of threads, for instance elements that through a handle provides a wedging effect.

The admission system may use one or several profiles with corresponding motor driven guiding elements attached to a platform. In the shown embodiment there are two parallel towers of profiles with a platform therein between, but it can also be used three or four towers of profiles according to the invention and the system may then be made more self-supporting in that the support element are placed between the towers instead of being attached in an external structure.

SHORT DESCRIPTION OF THE FIGURES

Figure 6:
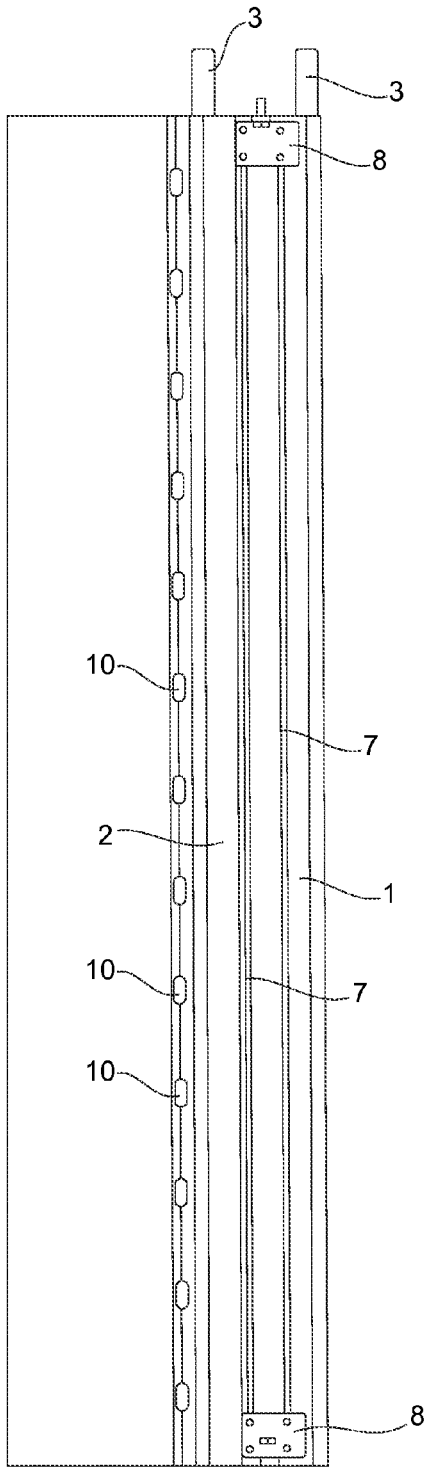
FIG. 6 is a side elevation of a profile according to the invention.
Figure 7:
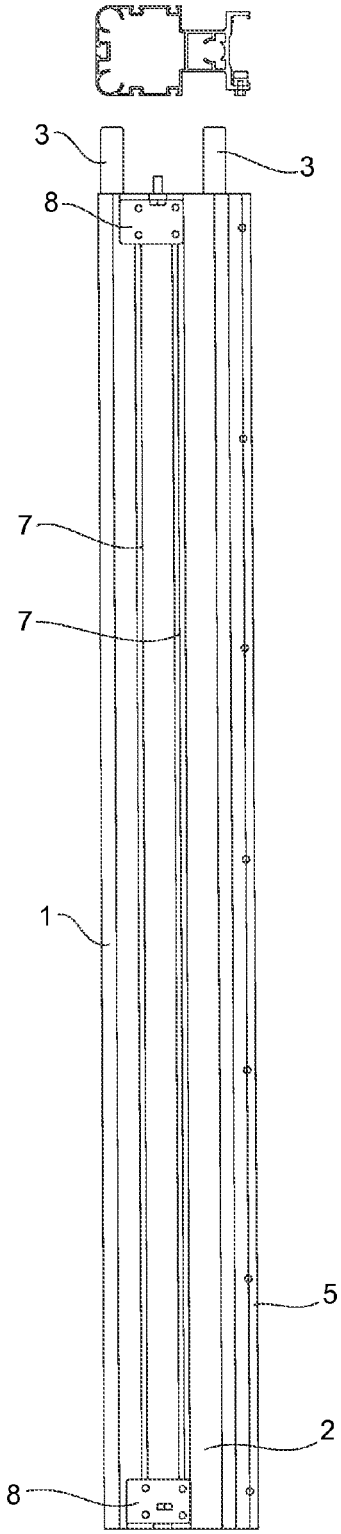
Figure 8:
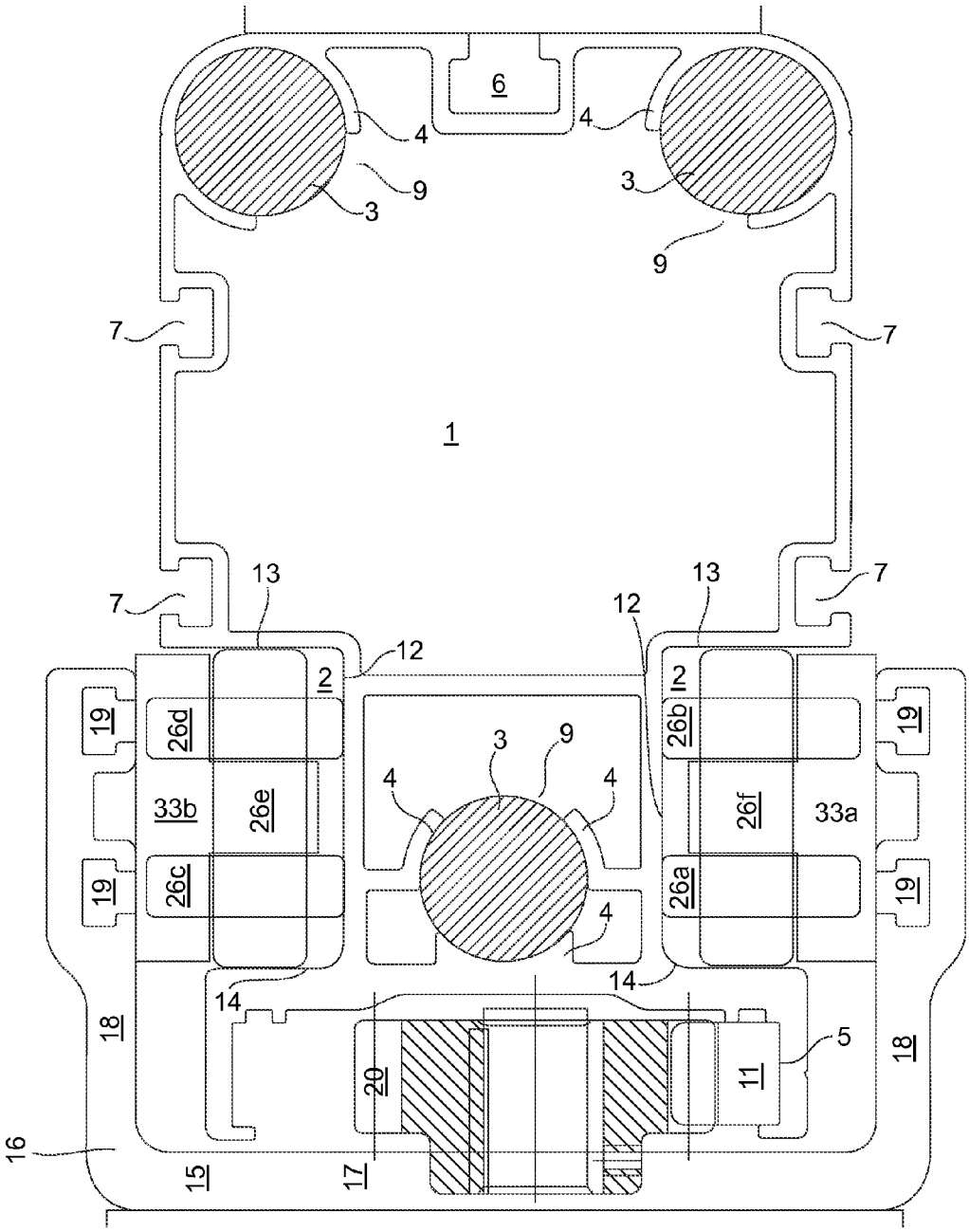
Figure 9:
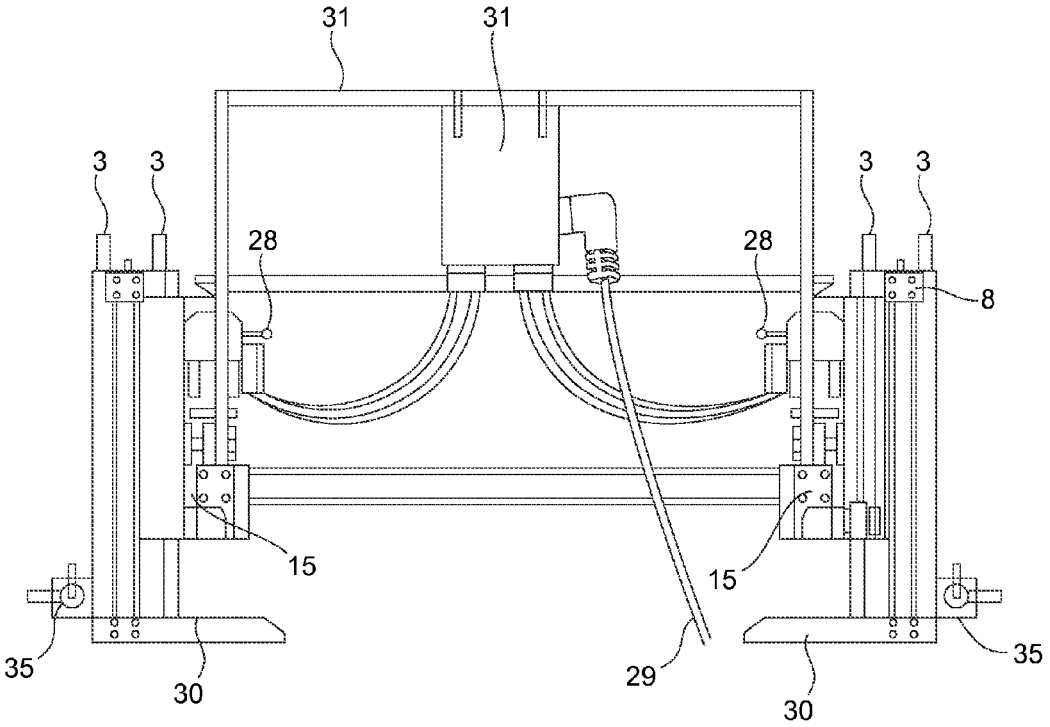
Figure 10A:
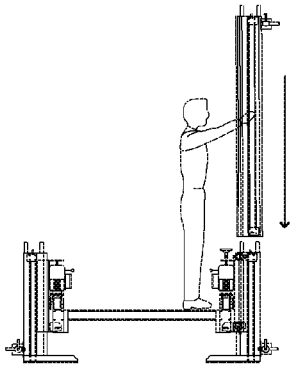
Figure 10B:
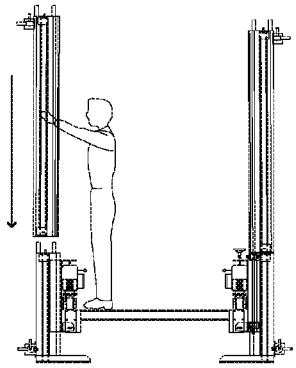
Figure 10C:
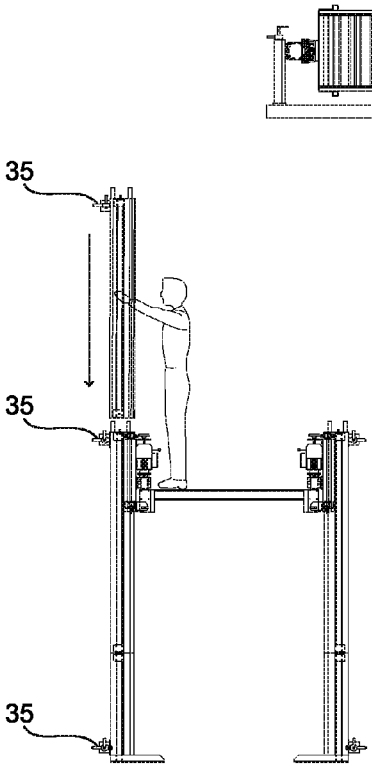
Figure 10D:
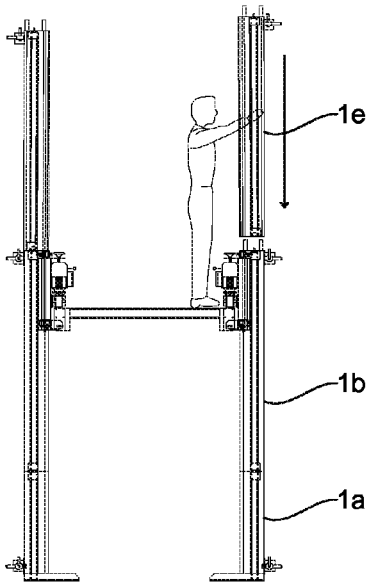
Figure 11:
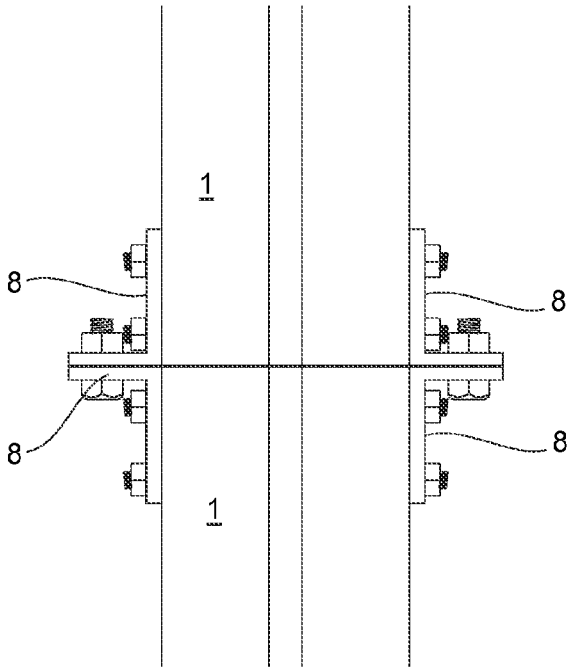
Figures 12A, 12B, 12C:
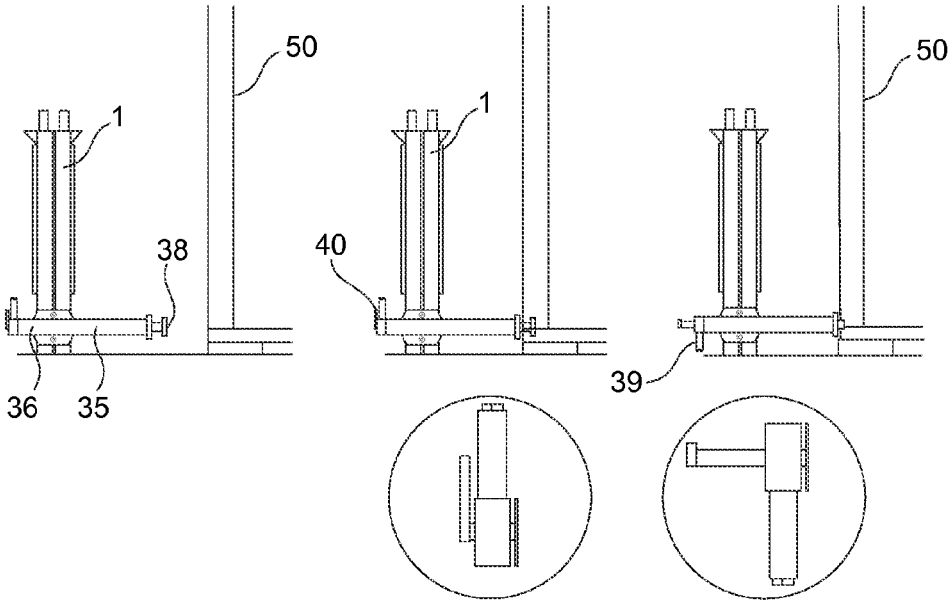
Figure 13:
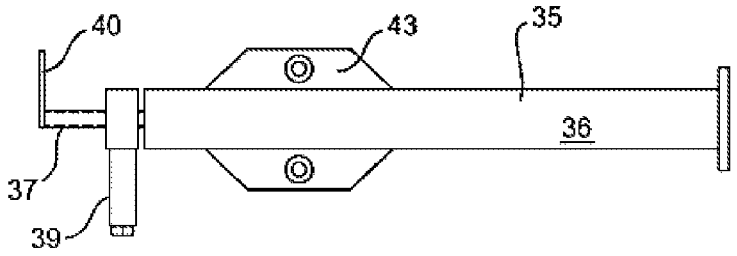
Figure 14:
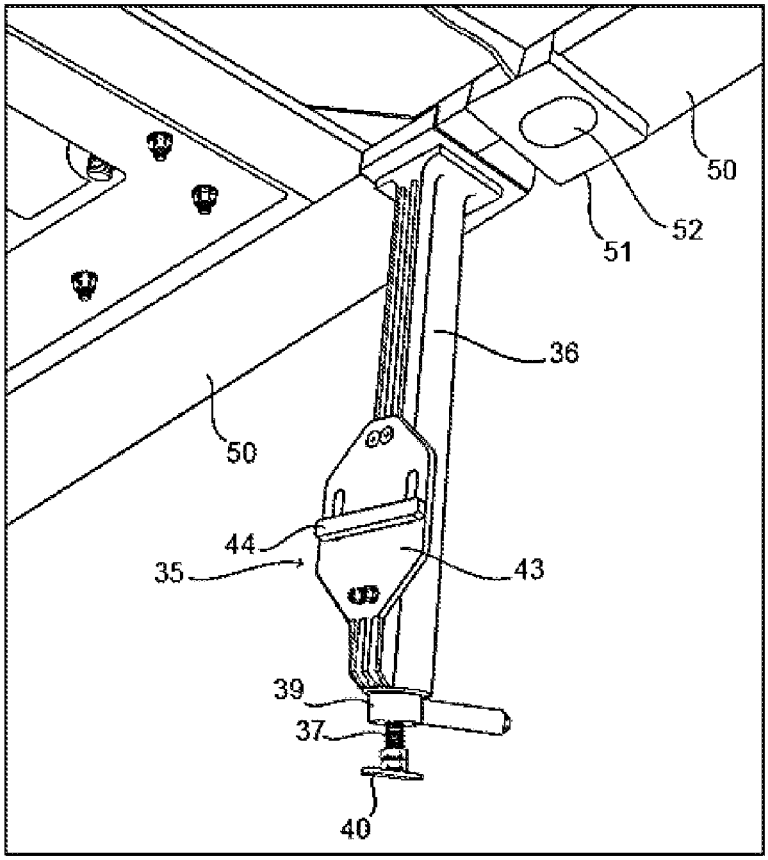

FIG. 7 corresponds to FIG. 6, from the other side;

FIG. 8 is a cross-section of the profiles according to the invention;

FIG. 9 shows the invention assembled;

FIGS. 10*a-d* show various steps during assembly of the invention;

FIG. 11 shows a detail of how the profiles are assembled;

FIGS. 12*a-c* show various steps during attachment to a container;

FIG. 13 shows a support element according to the invention;

FIG. 14 shows the support element attached in a container; and

Figure 15:
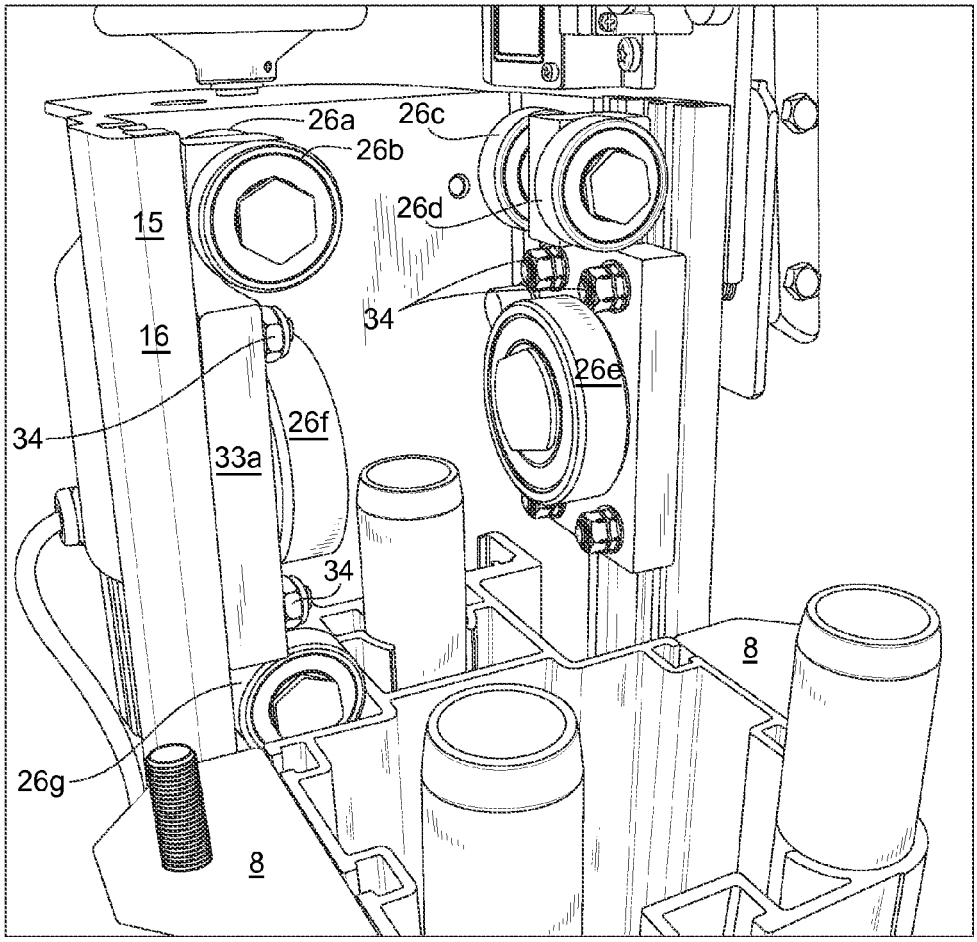

FIG. 15 shows details in connection with the rolling elements.

DETAILED DESCRIPTION OF AN EMBODIMENT OF THE INVENTION WITH REFERENCE TO THE ENCLOSED FIGURES

Figure 1:
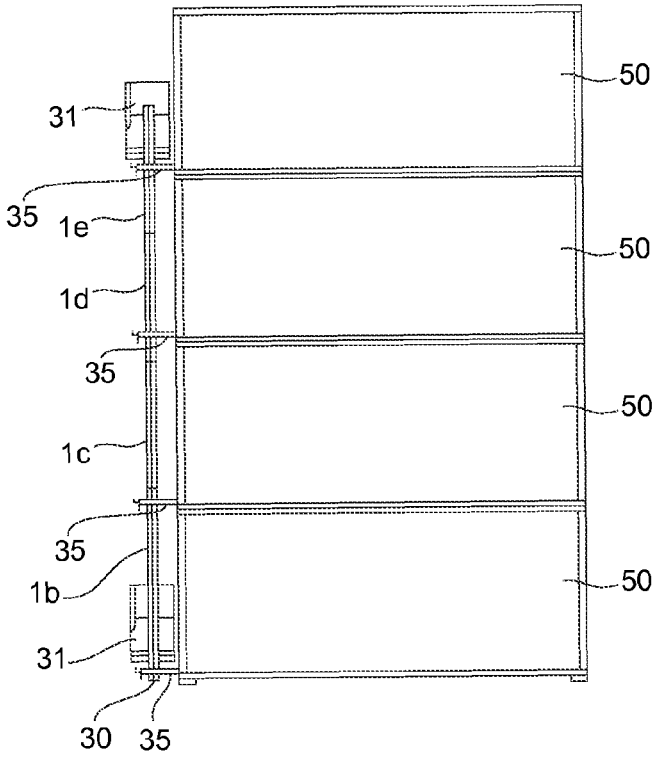
FIG. 1 is a side elevation of an admission system according to an embodiment of the invention.

In FIG. 1 it is shown an admission system according to an embodiment of the present invention. The admission system is portable and is designed to be erected manually and to be built to a desired height by manual force without considerable limitations.

The system is shown attached to containers 50. FIG. 1 show four containers 50 stacked on top of each other. The platform that can be elevated is particularly designed to service or exchange cooling units placed on containers 50. The shown admission system includes two towers of sectioned, longitudinal, extruded aluminium tower sections or profiles 1. FIG. 1 show five profiles 1*a*-1*e*, assembled to a tower of a desired height, such that a working platform 31 can be elevated to a container 50 where work is to be performed. FIG. 1 show two platforms 31, whereas a lifting system clearly would include only one working platform. FIG. 1 show two working platforms to show the platform at various positions. The lowermost longitudinal profile 1*a* includes a foot piece 30 that forms along with the foot piece, a bottom tower or portal with certain stability. Support elements 35 are placed between the containers 50 and the profiles 1 to stabilise the profiles.

Figure 2:
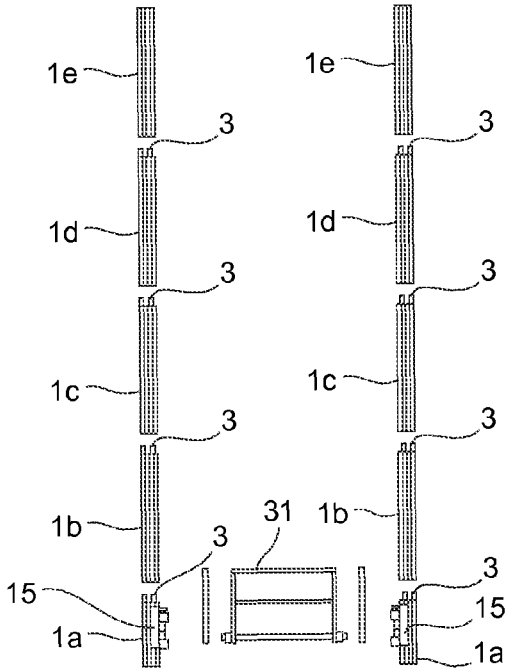
FIG. 2 is a front elevation, where an admission system is shown in its various constituents before they are assembled.

FIG. 2 shows the various elements or modules of the admission system, and the bottom towers with profiles 1*a* are shown somewhat shorter than the other profiles 1*d*-1*e*. The platform 31 itself is shown with a removable railing. The drive assemblies or guiding elements 15 are shown attached to the bottom towers with profiles 1*a*. The interconnecting elements 3 extend up from the profiles 1*a*-1*e*, such that the interconnecting elements extend into the profiles. The profiles 1*b*-1*e* are similar.

Figure 3:
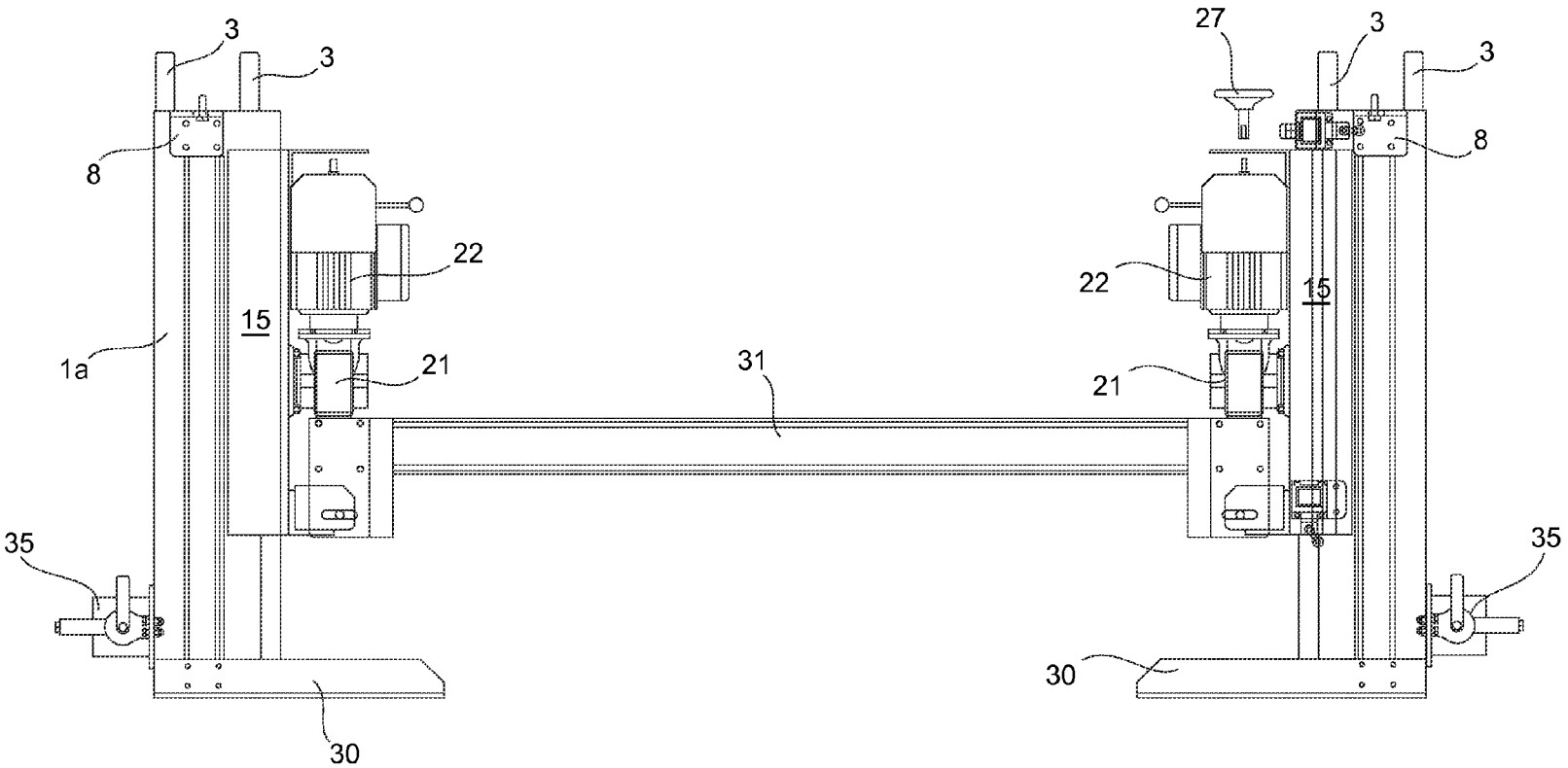
FIG. 3 shows two portal parts with platform and guiding elements.

FIG. 3 shows the bottom towers with the foot pieces 30, the profiles 1*a*, the interconnecting elements 3 and end attachments 8. The end attachments 8 are shown as flange portions attached in the profiles 1*a*, and are made with a bolt connection for attachment to a profile that is placed above. Two similar bottom towers are shown, where one tower is placed at each side of platform 31. Each tower is shown with guiding elements 15, motor 22 and transmission 21 attached thereto. Electric motors are shown, but it can of course also be used pneumatic, electric or any other motors as needed. For some applications may even combustion engines be suitable. The guiding system must be adapted to the type of motor that is used. A wheel for emergency operation 27 is provided for adjustment and for lowering the platform in the case of loss of power or other problems. The wheels for emergency operation may also be used to raise or elevate the platform somewhat to release locking elements (not shown) extending from the guiding elements 15 and into openings in the profiles to lock the profile at a certain height. The support elements 35 hold the bottom towers to a container (not shown).

Figure 4:
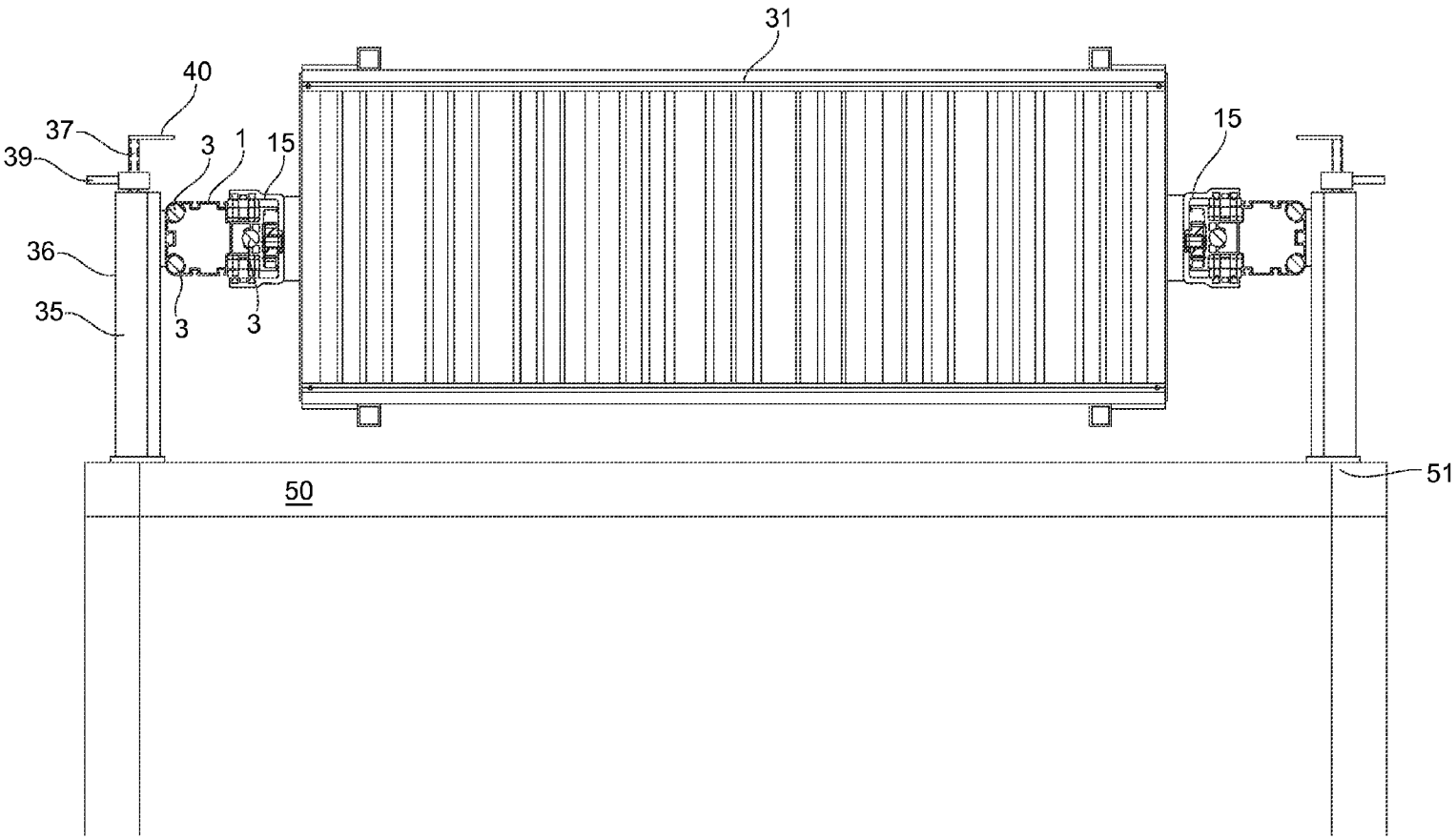
FIG. 4 shows the admission system from above.

In FIG. 4 the invention is shown from above in greater detail. In the figure the support elements 35 are shown in greater detail. The support elements 35 include an elongate housing or hollow longitudinal portion 36, typically of an extruded aluminium profile, with a guiding handle 40, an elongate rod or rod shaped body 37 and a tightening element 39. The guiding handle 40 is fixed to the rod shaped body 37 such that an operator may turn a locking member or plate shaped body (not shown) attached to the rod shaped body 37 extending into a longitudinal hole in the container for turning the plate shaped body to a certain angle such that the plate shaped body is locked against the edges of the hole in the container 50. The tightening element 39 that includes internal threads that extend into external threads on the rod shaped body 37 can then be turned and thereby pull the rod shaped body 37 and tighten the plate shaped body against the edge of the hole in the container 50. The container 50 is normally equipped with a container attachment portion with a container attachment opening (not shown) that is standard for containers. A platform 31 is shown placed between the guiding elements 15. FIG. 4 also shows a cross section of the profiles 1 and the interconnecting elements 3 placed in the profile 1.

Figure 5:
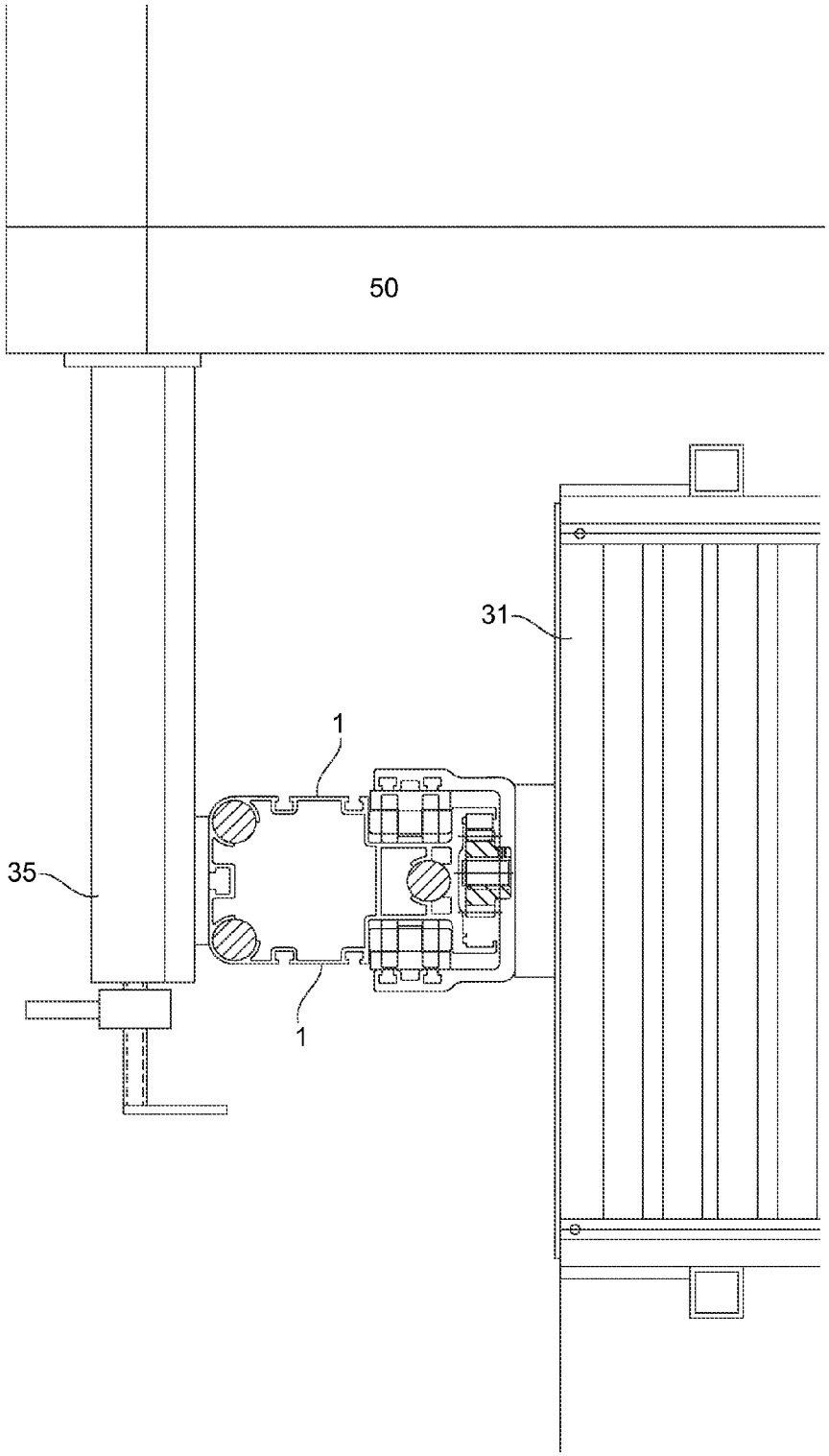
FIG. 5 shows a part of FIG. 4, where the elements are shown in a greater detail.

FIG. 5 corresponds to FIG. 4, and shows the support element 35, the profile 1, the platform 31 and the container 50 in greater detail.

In FIG. 6, the profile 1 is shown in greater detail from the side. The profile includes slits 7 for attachment of end attachments 8. The slits are typically designed for installation of a bolt with a suitable bolt head, adapted nuts or protruding bolts or threaded holes. Other kinds of tightening mechanisms may of course also be installed in the slits. The FIGS. 6 and 7 show two slits 7 at each side of the profile 1. Furthermore FIG. 6 shows recesses 10 for contact with a locking pawl (not shown) and lines indicating a recessed portion 2. Interconnecting elements 3 are shown installed into one end of the profiles, and the interconnecting elements 3 are adapted to extend into corresponding holding portions in an adjacent profile. Thereby may each profile 1 be designed such that all the profiles are similar.

In FIG. 8 the longitudinal extruded profiles 1 and the guiding element 15 are shown in greater detail. FIG. 8 shows a cross-section of the profiles. The longitudinal extruded profile 1 is shown with four slits 7 for attachment of end fixing portions, a slit 6 for attachment of support elements, three interconnecting elements 3 and internally placed holding portions 4 for contact with the interconnecting elements 3. The holding portions 4 include internally cylindrical areas for contact with cylindrical interconnecting elements 3. The interconnecting elements hold the profiles in the right position to keep the profiles together when the end attachments 8 (not shown in FIG. 8) are attached by bolts. The holding portions 4 include an open deformation portion 9 allowing a certain deformation of the profile when the interconnecting elements 3 are pressed into the holding portions 4.

A U-shaped profile 16 forming a part of the guiding element 15 is shown with a plane bottom portion 17 and plane side portions 18. The profile is furthermore made with internal slits 19 for attachment of guiding elements, preferably of rolling elements 26*a*-26*f*. The extruded profile 1 also includes a portion 5 for attachment of a toothed rack 11. The toothed rack 11 meshes with a pinion 20 for propulsion of the guiding element 15 up and down along the profiles 1.

FIG. 9 shows two portals or bottom towers with foot pieces 30, and guiding elements 15 placed on the bottom tower. The lower part of the bottom towers are attached to a container by the support elements 35. Interconnecting elements 3 are shown for interconnection with there above located profiles shown on top of the bottom towers. Operating handles 28 may operate a mechanism releasing the motors from the transmission, such that the platform 31 can be led downwards in the event of loss of energy. A connection box and motor control 32 is shown connected to a supply of electricity 29. The connection box 32 may include various components that measures movement and inclination of the platform 31. End attachments 8 are shown attached to the profile for attachment of profiles that are to be put on top.

FIGS. 10*a*-10*d* show four steps during assembly of the portable lifting unit. When each bottom tower is located, and the platform is placed between the bottom towers, may the extruded profiles 1*b* be placed on top of the profiles 1*a*, and may be attached to these by the end fixings 8. The end fixings 8 may be held together by bolts or in any other way. When then two profiles 1*b* are placed on top of the profiles 1*a*, the platform may be raised or elevated to a desired height, and further profiles 1*c* may be placed on top of the profiles 1*b* to be able to increase the lifting height further. These steps are repeated and new profiles are placed on top of already attached profiles until the desired height is achieved. Suitable support elements 35 are placed at suitable distances, and are attached to the profiles and to the containers. The support elements 35 hold the profiles and thereby the platform in place.

FIG. 11 show profiles 1 and end fixings 8 in greater detail, and how the end fixings 8 (four parts) are attached to each other by screws and are screwed onto the profiles 1.

FIGS. 12*a*-12*c* show how a locking member or plate shaped body 38 placed on the support element 35 may be led into a hole in a container 50, the control handle 40 is turned 90 degrees, and thereby the plate shaped body 38 is turned, the tightening element 39 is then turned around the threaded rod shaped body such that the rod shaped body pulls the plate shaped body 38 and is locked against the container 50. The support element 35 is then tightened towards the profile 1, and the profile 1 is held in place.

FIG. 13 shows the support element 35 in greater detail, where the hollow longitudinal portion 36 is shown. This is also shown as an extruded profile with slits for sliding attachment of fixing elements. The control handle 41 can turn the rod shaped body 37 that also is attached in the plate shaped body, and can thereby turn the plate shaped body such that the plate shaped body is locked against the elongated hole in the container. The tightening element 39 with internal threads then turns in relation to the rod shaped body 37 such that the rod shaped body 37 is pulled outwards and pulls the plate shaped body tight towards the container. Attachment flanges 43 are attached in a sliding attachment rail that goes into slits in the profiles and nuts on the attachment flanges can be tightened such that the support element is tightened to the profiles.

FIG. 14 shows the support element 35, and the sliding attachment rail that can be tightened by nuts in greater detail. The sliding attachment rail 44 is adapted to slide in the internal slits 6 in the profiles 1. The sliding attachment rail 44 is shown attached in attachment flanges 43. The control handle 40, the rod shaped body 37 and the tightening element 39 are also clearly shown. The longitudinal body 36 extends towards the container 50. The container 50 is shown with a container attachment portion 51 with a longitudinal container attachment opening 52. Containers have as standard such longitudinal container attachment openings 52 at their upper and lower corners.

FIG. 15 shows how the end attachments 8 are led into the longitudinal extruded profile 1, and end attachments 8 with bolts for attaching a further profile.

The guiding element 15 is shown made of a U-shaped profile 16. Brackets 33*a*, 33*b* for the guiding, preferably rolling elements 26*a*-26*f* are fixed in the internal slits 19 in plane side portion 18 of the U-shaped profile 16 by bolts 34. (The U-shaped profile 16, the plane side portion 18 and the internal slits 19 are shown in FIG. 8). The steering/rolling elements 26 are shown as ball- or rolling bearings, but other rolling elements may be used. Alternatively, blocks with low friction may also be used. The bracket 33*a* is placed at the same side as the toothed rack 11. The toothed rack 11 is shown on FIG. 8. The bracket 33*a* include four rolling elements 26*a*, 26*b*, 26*g* that are supported against a bottom face 12 in the recessed portion 2 shown on FIG. 8. In FIG. 15 it is only shown three rolling elements, but this is because the last rolling element not is visible on the figure. A rolling element is present at the side of the rolling element 26*g*. The reason for using four rolling elements that abuts the bottom face 12 is to oppose the forces that are imposed on the toothed rack 11 by the pinion 20 as shown on FIG. 8. The bracket 33*a* further includes rolling element 26*f* placed perpendicular to the rolling elements 26*a*, 26*b*, 26*g* and this rolling element 26*f* abuts either the first side face 13 in the recessed portion 2, or the second side face 14 in the recessed portion 2, depending on how the guiding element 15 is loaded. The guiding element 15 may typically include several brackets 33*a* with corresponding rolling elements 26.

A second bracket 33*b* is attached in the same way as bracket 33*a* by bracket attachment bolts 34 placed in internal slits 19 in the U-shaped profile 16. The bracket 33*b* only include two rolling elements 26*c*, 26*d* abutting the bottom face 12 in the recessed portion 2 on the opposite side of the recessed portion 2 at the same side as the toothed rack 11. The bracket 33*b* only include two rolling elements 26*c*, 26*d* as the forces on this side are smaller due to the forces between the toothed rack 11 and the pinion 20. A further rolling element 26*e* perpendicular to the rolling elements 26*c*, 26*d* is placed in the recessed portion 2 to support on the first side face 13 in the recessed portion 2 and will abut the first side face 13 or the second side face 14 in the recessed portion 2, depending on how the guiding element 15 is loaded.

The invention claimed is:

1. A system for accessing a container including a plurality of attachment openings and a cooling unit, the system comprising:

a pair of towers, wherein each tower has a vertically oriented longitudinal axis and includes a plurality of elongate tower sections coupled together end-to-end;

a toothed rack extending along each tower, wherein the toothed rack is oriented parallel to the longitudinal axis of the corresponding tower;

a raisable platform positioned between the pair of towers and configured to move vertically relative to the pair of towers;

a pair of drive assemblies coupled to the raisable platform, wherein each drive assembly includes a pinion configured to mesh with one of the toothed racks and a transmission configured to rotate the pinion relative to the corresponding toothed rack;

wherein each tower section includes at least one elongate recess oriented parallel to the longitudinal axis and configured to receive a first steering element coupled to one of the drive assemblies; and a plurality of support elements configured to couple the towers to the container, wherein each support element comprises:

an elongate housing having a horizontally oriented central axis;

an elongate rod extending through the housing along the central axis and configured to rotate relative to the housing along the central axis, wherein the rod has a first end and a second end opposite the first end;

a locking member fixably attached to the first end of the rod, wherein the locking member has a profile configured to axially pass through one attachment opening along the central axis of the elongate housing in a first rotational orientation and be prevented from axially passing through the one attachment opening along the central axis of the elongate housing in a second rotational orientation; and a guiding handle coupled to the second end of the rod and configured to rotate the rod about the central axis of the housing to transition the locking member between the first rotational orientation and the second rotational orientation; and a tightening mechanism coupled to the second end of the rod, wherein the tightening mechanism is configured to move the rod and locking member axially relative to the elongate housing with respect to the central axis of the housing.

2. The system of claim 1, wherein each tower section comprises an extruded profile including:

a first axially extending recessed portion, wherein the first steering element of one of the drive assemblies is configured to engage with the first recessed portion;

a portion for attachment of the toothed rack; and a slit for attachment of one of the plurality of support elements.

3. The system of claim 2, further comprising a plurality of interconnecting elements configured to connect the plurality of elongate tower sections of each tower together;

wherein each tower section includes a plurality of internally placed holding portions configured to receive one of the interconnecting elements.

4. The system of claim 2, wherein each tower section further includes a second axially extending recessed portion, wherein a second steering element is coupled to one of the drive assemblies and is configured to engage the second recessed portion.

5. The system of claim 2, wherein each drive assembly includes:

a substantially U-shaped extruded profile with a substantially planar bottom portion, a pair of substantially planar side portions, and a slit extending internally along one of the substantially planar side portions configured to receive the first steering element;

wherein the transmission is coupled to the U-shaped extruded profile;

an attachment device configured to attach the drive assembly to the platform; and a locking assembly configured to lock the drive assembly to one of the tower sections.

6. The system of claim 5, wherein the elongate housing of each support element includes an attachment flange, and an attachment rail coupled to the attachment flange, wherein the attachment flange is configured to engage one of the tower sections of one of the pair of towers.

7. The system of claim 1, wherein the tightening mechanism includes a tightening element having internal threads; and wherein the elongate rod includes external threads that mate and engage the internal threads of the tightening mechanism.

8. The system of claim 7, wherein the elongate housing of each support element includes an attachment flange, and an attachment rail coupled to the attachment flange, wherein the attachment flange is configured to engage one of the tower section of one of the pair of towers.

9. The system of claim 1, wherein each of the tower sections comprises a cross-section, wherein the cross-section of each tower section is substantially the same;

wherein the each tower section of each of the pair of towers is connected to one another through a plurality of interconnecting members;

wherein each of the tower sections of the pair of towers is configured to be carried by a person; and wherein the locking member includes parallel sides and is transitioned from the first orientation to the second orientation by rotating the locking member approximately 90 degrees about the central axis of the elongate rod.

10. A method for assembling an admission system built from elements configured to be carried along a plurality of stacked containers placed on a surface, the method comprising:

placing a foot piece on the surface;

coupling a first tower section to the foot piece, the first tower section including a toothed rack coupled thereto;

coupling a drive assembly to the first tower section, the drive assembly including a steering element, a pinion configured to mesh with the toothed rack, and a transmission configured to rotate the pinion relative to the corresponding toothed rack;

coupling a working platform to the drive assembly;

coupling a second tower section to the first tower section with a first interconnecting element;

coupling one of the first tower section or the second tower section to one of the plurality of stacked containers with a support element;

raising the platform by rotating the pinion;

connecting a third tower section to the second element with a second interconnecting element;

extending a locking member of the support element into an attachment opening of one of the plurality of stacked containers; and changing the orientation of the locking member after extending the locking member into the attachment opening to prevent the locking member from passing through the attachment opening.

11. The method of claim 10, wherein the locking member is fixably attached to a first end of a rod further including a second end and a central axis; and wherein changing the orientation of the locking member comprises rotating the locking member about a central axis of the rod.

* * * * *